US005970522A

United States Patent [19]

Apichom

[11] Patent Number: 5,970,522

[45] Date of Patent: Oct. 26, 1999

[54] COSTUME MASK

[76] Inventor: Surasak Apichom, 372 Carrol Park E., Unit 305, Long Beach, Calif. 90814

[21] Appl. No.: 09/206,654

[22] Filed: Dec. 7, 1998

[51] Int. Cl.[6] ..... A42B 1/00

[52] U.S. Cl. ..... 2/206; 446/27

[58] Field of Search ..... 2/206, 9, 173, 2/424, DIG. 3, DIG. 10; 446/27

[56] References Cited

U.S. PATENT DOCUMENTS

| | | | |
|---|---|---|---|
| 885,802 | 4/1908 | Sterrick . | |
| 2,203,562 | 6/1940 | Edwards | 2/206 |
| 2,606,324 | 8/1952 | Mafko | 2/206 |
| 2,666,204 | 1/1954 | Mafko | 2/206 |
| 2,666,205 | 1/1954 | Mafko | 2/206 |
| 2,748,528 | 6/1956 | Wolf | 46/44 |
| 3,883,982 | 5/1975 | McClary | 46/1 |
| 5,504,943 | 4/1996 | Han | 2/209.13 |
| 5,787,508 | 8/1998 | Gattamorta | 2/206 |

*Primary Examiner*—Diana Oleksa
*Attorney, Agent, or Firm*—Eric Karich

[57] ABSTRACT

A costume mask has a mask body shaped to fit over the face of the user. The mask body has an inflatable sack positioned thereon such that inflating the inflatable sack causes a feature to protrude to an extended position. The inflatable sack and the feature are preferably both made of a very thin and lightweight material to enable the inflatable sack to inflate and deflate quickly, thereby causing the feature to leap quickly outward at the observers for startling effect. The costume mask further includes a means for retracting the feature, preferably a coil spring that connects the feature to the mask body, biasing the feature to a retracted position.

2 Claims, 3 Drawing Sheets

Fig. 3
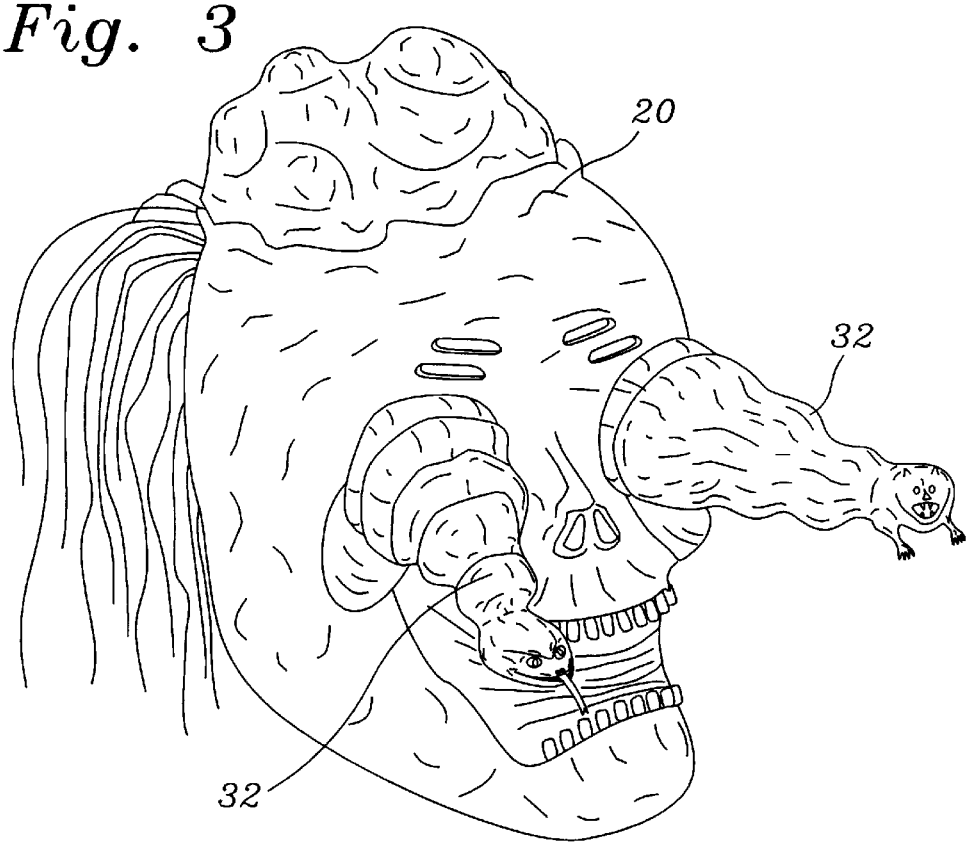
Fig. 4
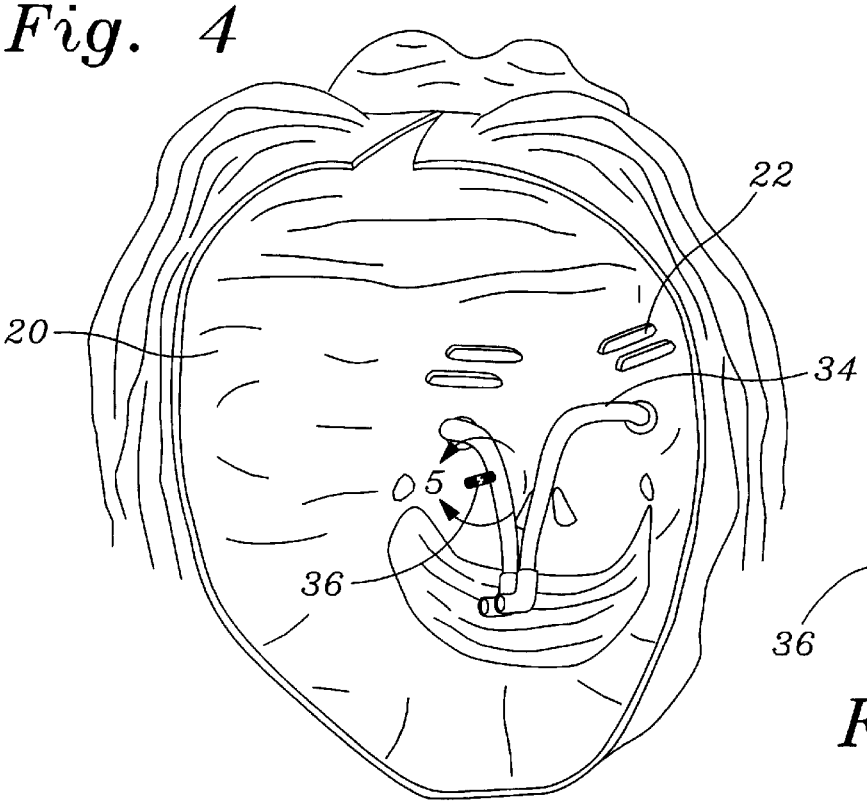
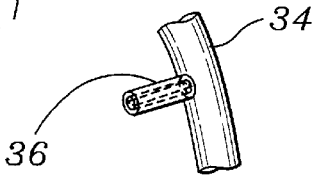
Fig. 5

COSTUME MASK

BACKGROUND OF THE INVENTION

1. Field of the Invention

This invention relates generally to a costume mask designed to be worn over a user's face, and more particularly to a costume mask having features that jump outwardly to startle observers.

2. Description of Related Art

Costume masks are well known in the prior art. Various costume masks that change their appearance in humorous ways have also been devised. Sterrick, U.S. Pat. No. 885,802, discloses a toy mask having facial features that can be expanded by blowing air into a rubber bladder under the facial feature. Similar devices are disclosed in Edwards, U.S. Pat. No. 2,203,562, and Mafko, U.S. Pat. Nos. 2,606,324, 2,666,204, and 2,666,205 all disclose masks having facial features that can be distorted when the user blows air into a chamber behind the facial feature. Mafko also discloses the use of a noise-maker as part of the mask. Similar inventions are disclosed in Edwards, U.S. Pat. No. 2,203,562, Wolf, U.S. Pat. No. 2,748,528, and McClary, U.S. Pat. No. 3,883,982. More recent patents include Han, U.S. Pat. No. 5,504,943 and Gattamorta, U.S. Pat. No. 5,787,508.

The prior art teaches various masks having facial features that can be altered in humorous ways by the user. However, the prior art is limited to features that slowly bulge in a humorous way. The movement of the features is always limited to the elasticity of the material of which the feature is constructed. The prior art does not teach an inflatable sack that is retracted by a separate means for retraction, preferably a coil spring. This flexibility enables a movable facial feature that leaps outwardly to startle observers. The present invention fulfills these needs and provides further related advantages as described in the following summary.

SUMMARY OF THE INVENTION

The present invention teaches certain benefits in construction and use which give rise to the objectives described below.

The present invention provides a costume mask for covering a face of a user, the costume mask including a mask body shaped to fit over the face of the user and having an inflatable sack positioned on the mask body such that inflating the inflatable sack causes a feature to protrude to an extended position. The inflatable sack and the feature are preferably both made of a very thin and lightweight material to enable the inflatable sack to inflate and deflate quickly, thereby causing the feature to leap quickly outward at the observers for startling effect. The costume mask further includes a means for retracting the feature, preferably a coil spring that connects the feature to the mask body, biasing the feature to a retracted position.

A primary objective of the present invention is to provide a costume mask having advantages not taught by the prior art.

Another objective is to provide an inflatable sack and feature made of thin and lightweight material, allowing the feature to leap outward to an extended position, thereby startling observers.

A further objective is to provide a means for retracting the feature, enabling the lightweight inflatable sack to resume its retracted position.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 3 is a perspective view thereof, the features appearing to be animals, namely a rat and a snake;

FIG. 4 is a back perspective view showing an inflation tube having a whistle;

FIG. 5 is an enlarged view of the whistle taken along line 5—5 in FIG. 4;

DETAILED DESCRIPTION OF THE INVENTION

Figure 1:
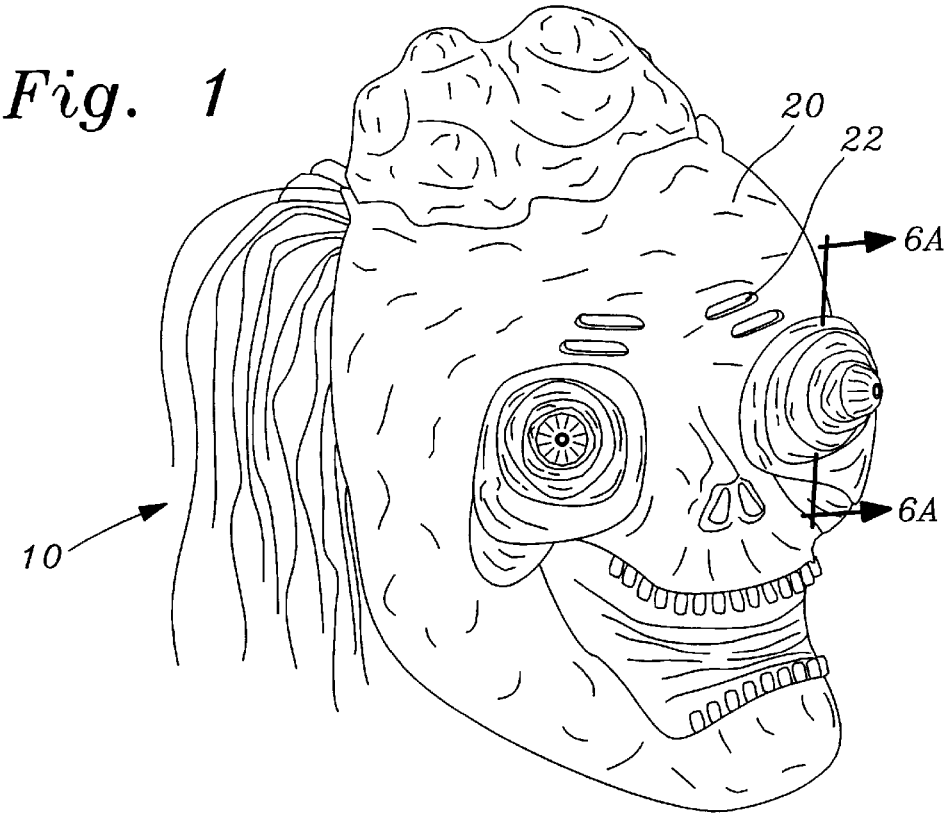
FIG. 1 is a perspective view of the preferred embodiment of the present invention, the view showing a pair of features resembling eyeballs, the features being in their retraction positions.

The above described drawing figures illustrate the invention, a costume mask 10 for covering a face of a user. As shown in FIG. 1, the costume mask 10 includes a mask body 20 shaped to fit over the face of the user. The mask body 20 preferably includes viewing holes 22 through which the user can see. The mask body 20 is typically made of rubber molded to resemble a skull, a wolf, or other frightening creature; however, the mask body 20 is made of cloth or other material in alternative embodiments. The mask body 20 preferably further includes hair, paint, and other features necessary to make the costume mask 10 appear to be realistic and frightening. Such a mask body 20 is well known in the art and a variety of shapes, sizes, and styles are generally available.

Figure 2:
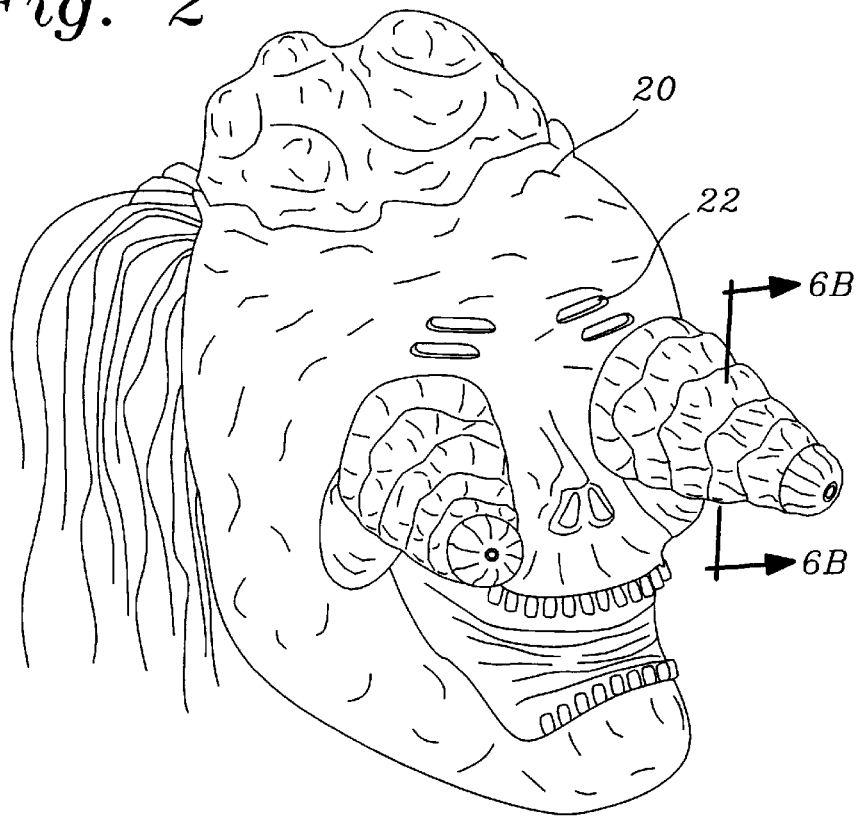
FIG. 2 is a perspective view thereof showing the pair of eyeballs protruding in their extended positions.
Figure 6B:
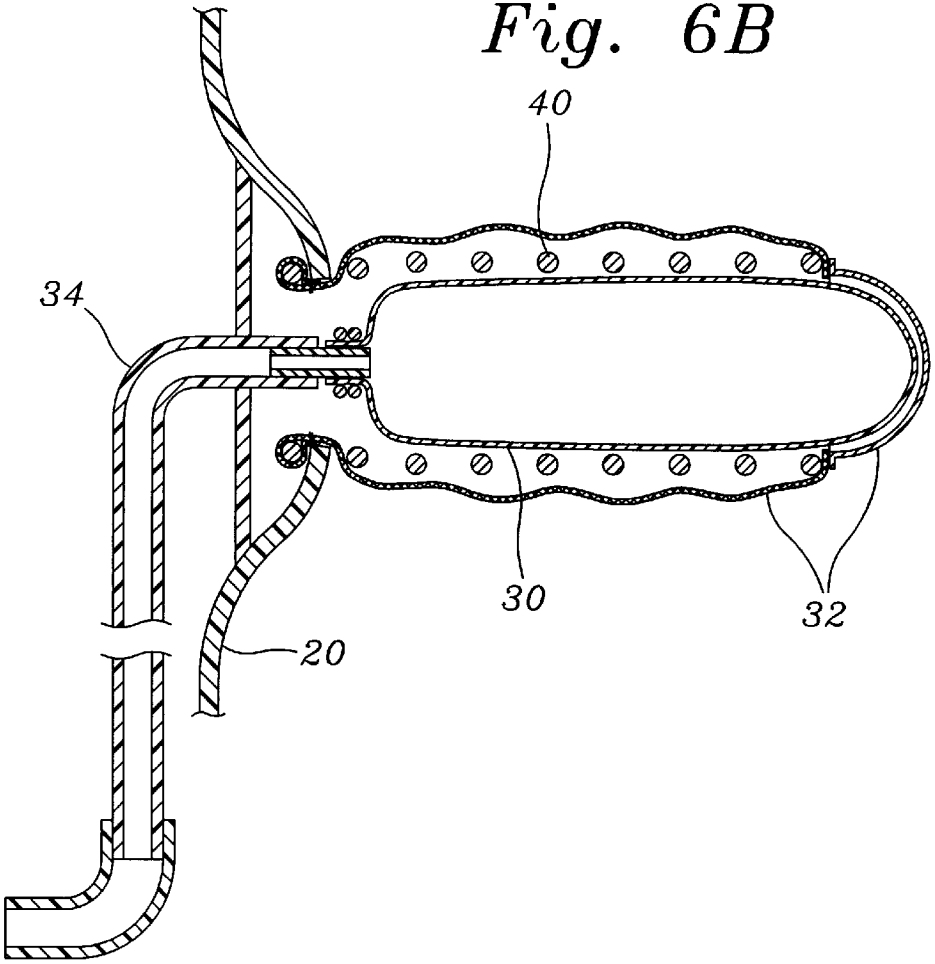
FIG. 6B is a sectional view of the coil spring holding the inflation sack in its extended position, the view taken along line 6B—6B in FIG. 2.
Figure 6A:
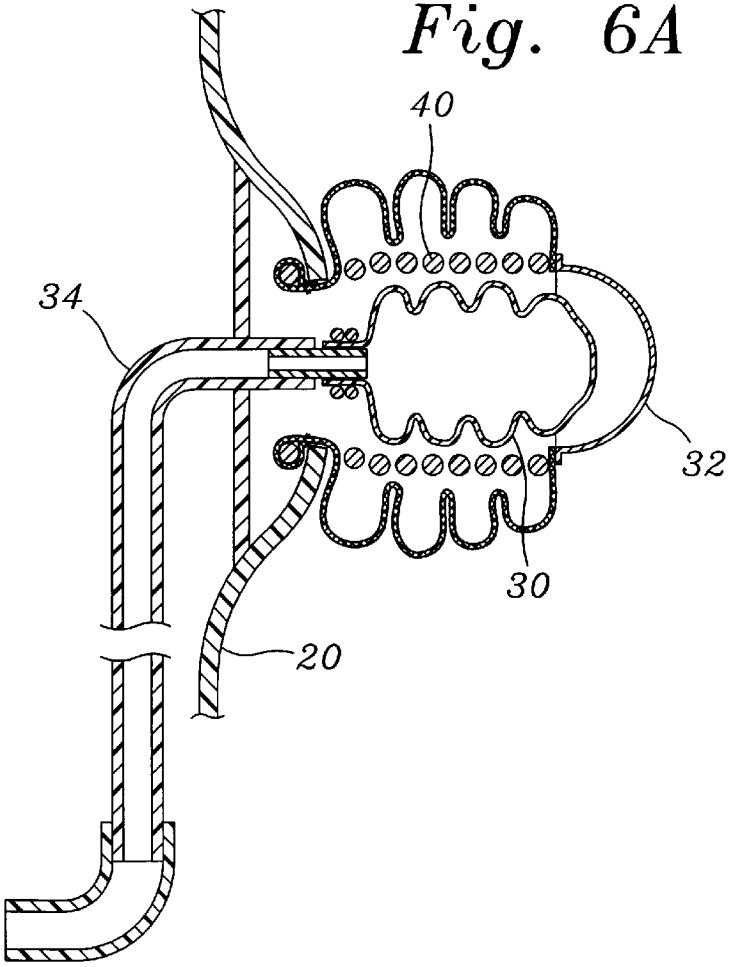
FIG. 6A is a sectional view of the coil spring holding the inflation sack in its retracted position, the view taken along line 6A—6A in FIG. 1.

As shown in FIG. 2, the mask body 20 includes an inflatable sack 30 positioned on the mask body 20 such that inflating the inflatable sack 30 causes a feature 32 to protrude outwardly in a startling fashion. This structure is somewhat similar to Sterrick, U.S. Pat. No. 885,802, hereby incorporated by reference in full. The inflatable sack 30 of this invention distinguishes over the prior art in that it is preferably an elongate sack made of a thin elastic material such as rubber. The thin, elongate nature of the inflatable sack 30 allows the feature 32 to leap outward a great deal further and faster than the prior art. The use of a thin inflatable sack 30 is enabled in this invention by the use of a means for retracting 40, described below. The inflatable 30 sack is covered by the feature 32, preferably a light material such as nylon, the material being shaped and painted to resemble a feature of the mask body 20. As shown in FIGS. 1 and 2, the feature 32 is preferably shaped to allow the feature 32 to expand with the inflatable sack 30. It is important that the inflatable sack 30 and the feature 32 are both made of a very thin and lightweight material to enable the inflatable sack 30 and feature 32 to inflate and deflate quickly, thereby causing the feature 32 to leap quickly outward at the observers for startling effect. The feature 32 is most preferably designed and positioned to resemble an eyeball and skin. In its most preferred embodiment, the mask body 20 has two inflatable sacks 30 and two features 32 shaped like eyeballs, thereby allowing the user to startle observers with a pair of eyeballs leaping forward unexpectedly. In an alternative embodiment, as shown in FIG. 3, the feature 32 resembles an animal such as a rat or a snake. The feature 32 preferably appears to emerge from an eye socket, as shown in FIG. 3. In alternative embodiments, the feature 32 emerges from a mouth or other location.

The costume mask 10 is actuated by a means for inflating 34 the inflatable sack 30. As shown in FIG. 4, the means for inflating 34 the inflatable sack 30 is preferably an inflation tube 34 that extends from the inflatable sack 30 to the mouth of the user when the user is wearing the costume mask 10. The inflation tube 34 preferably further includes a whistle 36. When the user blows air into the inflation tube 34 to inflate the inflatable sack 30, some of the air escapes through the whistle 36, causing the whistle 36 to emit a sharp noise to further startle any observers nearby.

Critical to the function of the invention, the costume mask 10 further includes a means for retracting 40 the feature 32 back to a retracted position, shown in FIG. 1. A means for retracting 40 is critical to this invention because, when the inflatable sack 30 is made of thin latex, it tends to droop down the face of the costume mask 10. The means for retracting 40 retracts the inflatable sack 30 to the retracted position thereby disguising the presence of the inflatable sack 30. The means for retracting 40 is preferably a coil spring that connects the feature 32 to the mask body 20, biasing the feature 32 to the retracted position. Inflating the inflatable sack 30 by blowing into the inflatable tube 34 temporarily overcomes the bias of the coil spring 40, causing the feature 32 to leap outward to an extended position, shown in FIG. 2. In the preferred embodiment, this movement is accompanied by the shrill shriek of the whistle 36. When the user quits blowing into the inflatable tube 34, the inflatable sack 30 deflates, and the coil spring 40 pulls the feature 32 back to the retracted position.

In use, the user wears the costume mask 10 to a party with the feature 32 in its retracted position, as shown in FIG. 1. When the user wishes to startle an observer, he or she blows into the inflation tube 34 thereby causing the feature 32 to leap outwards to the extended position. The abrupt movement is accompanied by the simultaneous shriek of the whistle 36.

The user then releases the inflation tube 34, allowing the coil spring 40 to retract the feature 32 to the retracted position, ready to startle another observer.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A costume mask for covering a face of a user, the costume mask comprising:

a mask body shaped to fit over the face of a user;

an inflatable sack positioned on the mask body and positioned such that inflating the inflatable sack causes a feature to move from a retracted position to protrude from the mask body;

a means for inflating the inflatable sack; and a coil spring that connects the feature to the mask body, the coil spring biasing the feature to the retracted position.

2. A costume mask for covering a face of a user, the costume mask comprising:

a mask body shaped to fit over the face of a user;

an inflatable sack positioned on the mask body and positioned such that inflating the inflatable sack causes a feature resembling an animal to protrude from the mask body;

a means for inflating the inflatable sack; and a means for retracting the feature.

* * * * *